US011433453B2

(12) United States Patent
Ferrer

(10) Patent No.: US 11,433,453 B2
(45) Date of Patent: Sep. 6, 2022

(54) DEVICE AND METHOD FOR MANUFACTURING A METAL ALLOY BLANK BY CENTRIFUGAL CASTING

(71) Applicant: SAFRAN AIRCRAFT ENGINES, Paris (FR)

(72) Inventor: Laurent Ferrer, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/761,998

(22) PCT Filed: Nov. 6, 2018

(86) PCT No.: PCT/FR2018/052736
§ 371 (c)(1),
(2) Date: May 6, 2020

(87) PCT Pub. No.: WO2019/092354
PCT Pub. Date: May 16, 2019

(65) Prior Publication Data

US 2020/0316682 A1 Oct. 8, 2020

(30) Foreign Application Priority Data

Nov. 7, 2017 (FR) ..... 1760453

(51) Int. Cl.
*B22D 27/02* (2006.01)
*B22D 13/06* (2006.01)
(Continued)

(52) U.S. Cl.
CPC ..... *B22D 27/02* (2013.01); *B22D 13/026* (2013.01); *B22D 13/066* (2013.01); *B22D 21/005* (2013.01)

(58) Field of Classification Search
CPC . B22D 13/04; B22D 13/06–066; B22D 27/02
See application file for complete search history.

(56) References Cited

U.S. PATENT DOCUMENTS 2,963,758 A * 12/1960 Honeycutt ..... B22D 27/02 164/5
2004/0040690 A1 3/2004 Ranjan et al.
(Continued)

FOREIGN PATENT DOCUMENTS

CN 1796023 A 7/2006
CN 100999804 A 7/2007
(Continued)

OTHER PUBLICATIONS

Machine Translation of Takeya et al (JP 03-281052A, published Dec. 11, 1991, cited in IDS filed May 6, 2020). (Year: 1991).*
(Continued)

*Primary Examiner* — Kevin P Kerns
*Assistant Examiner* — Jacky Yuen
(74) *Attorney, Agent, or Firm* — Bookoff McAndrews, PLLC.

(57) ABSTRACT

A device (10) for manufacturing a metal alloy blank by centrifugal casting of a molten metal alloy, comprising a centrifugal casting wheel (20), the centrifugal casting wheel (20) being rotary about an axis of rotation (A) and comprising a mold (22) for receiving the molten metal alloy, the mold extending in a radial direction (R1) with respect to the axis of rotation (A). The device (10) comprises at least one magnet arranged in such a way as to induce an electric current in the mold (22) during the rotation of the centrifugal casting wheel (20) about the axis of rotation (A).

15 Claims, 7 Drawing Sheets

(51) Int. Cl.
*B22D 13/02* (2006.01)
*B22D 21/00* (2006.01)

(56) References Cited

U.S. PATENT DOCUMENTS

| | | | | |
|---|---|---|---|---|
| 2015/0352633 | A1* | 12/2015 | Foltz, IV ..... | B22D 13/06 164/286 |
| 2017/0173677 | A1 | 6/2017 | Lee et al. | |

FOREIGN PATENT DOCUMENTS

| | | | | |
|---|---|---|---|---|
| CN | 103357839 | A | | 10/2013 |
| FR | 3017062 | A1 | | 8/2015 |
| FR | 3019561 | A1 | | 10/2015 |
| JP | 03234341 | A | * | 10/1991 |
| JP | H 03281052 | A | | 12/1991 |
| JP | 2001096350 | A | | 4/2001 |

OTHER PUBLICATIONS

Office Action issued by the Chinese patent office in CN201880075810.X dated May 24, 2021 with English translation (13 pages).
Wu, X.Q. et al., "Structure Characteristics in Industrially Centrifugally Cast 25Cr20Ni Stainless Steel Tubes Solidified under Different Electromagnetic Field Intensity," *Journal of Materials Engineering and Performance,* vol. 8, pp. 525-530 (1999).
Yang, Y.S. et al., "Solidification of Alloys in Electromagnetic Field," *Zeitschrift fuer Metallkunde,* vol. 91, pp. 280-284 (2000).
International Search Report issued in International Application No. PCT/FR2018/052736 dated Jan. 15, 2019, with English translation (6 pages).

* cited by examiner

-PRIOR ART-

-PRIOR ART-

-PRIOR ART-

-PRIOR ART-

DEVICE AND METHOD FOR MANUFACTURING A METAL ALLOY BLANK BY CENTRIFUGAL CASTING

CROSS-REFERENCE TO RELATED APPLICATIONS

This application is the U.S. national phase entry under 35 U.S.C. § 371 of International Application No. PCT/FR2018/052736, filed on Nov. 6, 2018, which claims priority to French Patent Application No. 1760453, filed on Nov. 7, 2017.

BACKGROUND OF THE INVENTION

The present invention concerns the manufacturing of metal alloy blanks by centrifugal casting of a molten metal alloy, and particularly blanks of blades for turbomachines, in particular blades for aeronautical jet engines.

FIG. 1 shows a known manufacturing device which can be used for this manufacturing. The manufacturing device 100 comprises, in a closed and airtight chamber 150, a crucible 110 and a centrifugal casting wheel 120.

The crucible 110 is suitable for carrying out the melting of the metal alloy, which is for example provided in the form of an ingot 116 of metal alloy. Once this melting has been carried out, the molten metal alloy is poured into the centrifugal casting wheel 120.

The centrifugal casting wheel 120 is rotary about an axis of rotation A and comprises a mold 122 for receiving the molten metal alloy. The mold 122 extends in a radial direction R with respect to the axis of rotation A. One may for example refer to document FR 3 017 062 A1 for the construction of the mold 122.

The centrifugal casting wheel 120 is set to rotate about its axis of rotation A. During this rotation, the molten metal alloy is rapidly driven by the centrifugal force at the bottom of the mold 122. The speed of rotation of the centrifugal casting wheel 120 is chosen such that this centrifugal force is considerably greater than the gravitational force. The molten metal alloy solidifies gradually, at a speed of solidification less than the speed of filling of the mold 122; thus, the solidification is carried out on the whole of the mold 122, until the desired metal alloy blank is obtained. The metal alloy blank is then extracted from the mold 122 and can subsequently undergo further industrial steps (heat treatments, machining, forging etc.) to result in a finished part.

The casting step that has just been described has the advantage of reducing the porosity due to the shrinkage of the metal alloy during the solidification of the metal alloy blank. However, it also has drawbacks, which will be understood by referring to FIGS. 2 and 3.

FIG. 2 schematically shows the solidified metal blank in section along the plane C-C of FIG. 1 and makes it possible to observe the metallurgical microstructure thereof (the walls of the mold 122 and of the centrifugal wheel 120 have been left out to simplify the drawing).

At its center, the solidified metal blank 146 has a central region B1, composed of roughly equiaxed grains.

Near its walls, the blank 146 has a "skin" B3 composed of equiaxed grains of smaller dimensions than in the central region B1.

Between the central region B1 and the "skin" B3, the blank 146 has an intermediate region B2 composed of columnar grains (also known by the name of basalt grains). This intermediate region B2 is better visible in FIGS. 3A and 3B, which are photographs of sections along the radial direction R of two metallic blanks made of TA6V (titanium-based alloy comprising in the bulk 6% of aluminum and 4% of vanadium) obtained according to the method that has just been described, and in which the regions B1, B2 and B3 have been indicated.

The columnar grains of the intermediate region B2 cause very strong anisotropy, which is problematic for subsequent industrial steps.

In particular, when one wishes to machine the blank, since the mechanical and dynamic properties of the blank in the intermediate region B2 are very different according to the direction under consideration (perpendicular to the axis of the columnar grains or parallel to their axis), the responses of the material to the machining forces differ as a function of the cutting angle with respect to the axis of the columnar grains. Moreover, the relaxations of the machining stresses are also anisotropic.

The machining of the blank must be designed to take into account the previous factors, which tends to complicate it.

The parts that one wishes to produce by machining the blank must also be dimensioned to take into account the previous factors, which frequently leads to a non-optimal use of the material of the blank.

In addition, the directions of the axes of the columnar grains can vary from one region of the blank to another (which can for example be seen in FIG. 3B): in this case, the mechanical and dynamic properties of the blank, even in a given direction, can differ from one region to another of one and the same blank and/or from one blank to another. The design of the machining is then even more complex. It may even be that some of these blanks are totally unusable for machining, in which case they must be discarded.

It can therefore be seen that the manufacturing by centrifugal casting described above is not advantageous from the economic and industrial point of view when the blanks must be machined afterwards.

In addition, since the blank has a complex and varied metallurgical microstructure, its application properties (particularly mechanical) are very dispersed. Parts manufactured from this blank must be dimensioned in consequence of this, which tends to make them heavier. This is particularly undesirable when the part to be manufactured is a blade for an aeronautical jet engine, as such blades must be as light as possible in the interests of the jet engine's performance.

Moreover, the anisotropy caused by the columnar grains of the intermediate region B2, and the interfaces between the intermediate region B2 with columnar grains and the regions B1 and B3 with equiaxed grains, make it very difficult, or even impracticable, to perform simple operations of hot shaping of the blank, such as forging, rolling or extrusion. However, these operations can contribute new mechanical properties to the blank material. There is therefore a need for a new method for manufacturing a metal alloy blank by centrifugal casting which makes it possible to reduce the anisotropy of the blank and to simplify and make less expensive the subsequent operations to be carried out on the blank.

The patent document CN 1 796 023 A, CN 100 999 804 A and JP 2001-096350 A, and the articles Yang et al., "Solidification of Alloys in Electromagnetic Field", Zeitschrift fur Metallkunde, Carl Hanser, Munich, Del., vol. 91, no. 4, 2000-04-01, pages 280-284, XP000931909, and Wu et al., "Structure Characteristics in Industrially Centrifugally Cast 25Cr20Ni Stainless Steel Tubes Solidified under Different Electromagnetic Field Intensity", Journal of Materials Engineering and Performance, ASM International, Materials Park, Ohio, US, vol. 8, no. 5, 1999-10-01, pages 525-530, XP000877762, also disclose casting devices wherein the mold itself is rotationally driven about its own axis.

Subject and Summary of the Invention

To at least partially meet this need, the present invention provides a device for manufacturing a metal alloy blank by centrifugal casting of a molten metal alloy, comprising a centrifugal casting wheel, the centrifugal casting wheel being rotary about an axis of rotation and comprising a mold for receiving the molten metal alloy, the mold extending in a radial direction with respect to the axis of rotation, the device comprising at least one magnet arranged in such a way as to induce an electric current in the mold during the rotation of the centrifugal casting wheel about the axis of rotation.

The electric current induced by the magnet creates a Laplace force which tends to stir the molten metal alloy inside the mold. Owing to this stirring, the metal alloy blank has, after solidification, a homogenous macrostructure, virtually devoid of columnar grains, and therefore virtually isotropic, which eliminates the drawbacks described above.

In addition, owing to this stirring, the blank has virtually no residual porosity after cooling. This avoids the need to subject the blank to a step of Hot Isostatic Pressing (HIP), a step which also makes it possible to absorb these residual porosities but has the drawback of being long and very expensive.

According to one possibility, the centrifugal casting wheel comprises a coil surrounding an internal volume of the mold and configured in such a way that the magnet induces an electric current in the coil during said rotation of the centrifugal casting wheel about the axis of rotation.

In this way, an induced current is generated not only in the molten metal alloy (and where applicable in the structure of the centrifugal casting wheel), but also in the coil. The Laplace force exerted on the molten metal alloy is more intense. The result of this is that the stirring of the molten metal alloy inside the mold is more intense, which further improves the homogeneity of the metal alloy blank. It will moreover be noted that it is not necessary to connect the coil to a source of electricity, since an induced current is generated remotely in the coil. This avoids making provision for a particular connection of the coil to an electricity source not forming a single part with the centrifugal casting wheel, which would be complex from a mechanical point of view (risk of blocking of the centrifugal casting wheel by the power supply wires).

According to one possibility, the magnet is an annular or circular magnet, the axis of which is parallel to the axis of rotation.

In this way, the magnetic field generated by the magnet is substantially uniform over the whole of the volume swept by the mold during the rotation of the centrifugal casting wheel.

According to one possibility, the device comprises a plurality of magnets arranged in a spaced manner about the axis of rotation.

In this way, the magnetic field acting on the mold varies during the rotation of the centrifugal casting wheel. It follows that the electric current induced in the mold, and therefore the Laplace force exerted on the molten metal alloy, is variable during the rotation of the centrifugal casting wheel, which improves the stirring of the molten metal alloy inside the mold.

According to one possibility, the magnets are even in number, and the polarities of said magnets alternate evenly about the axis of rotation.

In this way, the magnetic field acting on the mold periodically changes direction during the rotation of the centrifugal casting wheel, which further improves the stirring of the molten metal alloy inside the mold.

According to one possibility, the magnet does not form a single part with the centrifugal casting wheel, and the device further comprises a permanent magnet forming a single part with the centrifugal casting wheel and extending partly across the coil.

According to one possibility, the magnet is an annular or circular magnet, the axis of which is parallel to the axis of rotation.

According to one possibility, the poles of the permanent magnet and of the magnet facing it have opposite names.

In this way, the magnetic field acting on the mold is virtually uniform at the coil. This increases the intensity of the electric current induced by the magnet in the coil, and therefore of the stirring of the molten metal alloy.

According to one possibility, the device comprises a plurality of magnets not forming a single part with the centrifugal casting wheel and arranged in a spaced manner about the axis of rotation.

According to one possibility, the magnets not forming a single part with the centrifugal casting wheel are even in number, and the polarities of said magnets alternate evenly about the axis of rotation.

According to one possibility, the axis of rotation is vertical.

In this way, the device for balancing the centrifugal casting wheel is simpler. The construction and the operation of the device are therefore simplified. Furthermore, the stirring of the molten metal alloy inside the mold is less disturbed. Specifically, during the rotation of the wheel, the molten metal alloy inside the mold is subjected to the centrifugal force and to the gravitational force. The centrifugal force is always radial to the axis of rotation. If the axis of rotation is vertical, the direction of the gravitational force does not vary either during the rotation of the wheel, such that the stirring is less disturbed.

According to one possibility, the radial direction is parallel to the horizontal.

In this way, the construction of the centrifugal casting wheel is simpler, in particular if the axis of rotation is vertical.

The present invention also provides a method for manufacturing a metal alloy blank, comprising the following steps:

melting of the metal alloy;

pouring of the molten metal alloy into a centrifugal casting wheel, the centrifugal casting wheel being rotary about an axis of rotation and comprising a mold for receiving the molten metal alloy, the mold extending in a radial direction with respect to the axis of rotation;

rotation of the centrifugal casting wheel about its axis of rotation and solidification of the molten metal alloy inside the mold, in such a way as to obtain the metal alloy blank; and extraction of the metal alloy blank from the mold, wherein, during the rotation step, a magnetic field is applied to the mold, in such a way as to induce an electric current in the mold.

According to one possibility, the centrifugal casting wheel comprises a coil surrounding an internal volume of the mold, and, during the rotation step, the magnetic field induces an electric current in the coil.

The method according to the invention offers the same advantages as the device according to the invention.

According to one possibility, the metal alloy is a titanium- or nickel-based alloy. The term "titanium-based" (or "nickel-based" respectively) is understood to mean that the titanium (or nickel respectively) is substantially, in the bulk, the majority element of the alloy.

Titanium- or nickel-based metal alloys are among the alloys currently used to produce blanks of parts subject to heavy mechanical stresses, such as blades for turbomachines, and more particularly blades for aeronautical jet engines.

According to one possibility, the metal alloy blank is a blank of a blade for a turbomachine, in particular of a blade for an aeronautical jet engine.

BRIEF DESCRIPTION OF THE DRAWINGS

The invention will be clearly understood, and its advantages will be more apparent, on reading the following detailed description of several embodiments, shown by way of non-limiting example. The description refers to the appended drawings wherein.

DETAILED DESCRIPTION OF THE INVENTION

Figure 1:
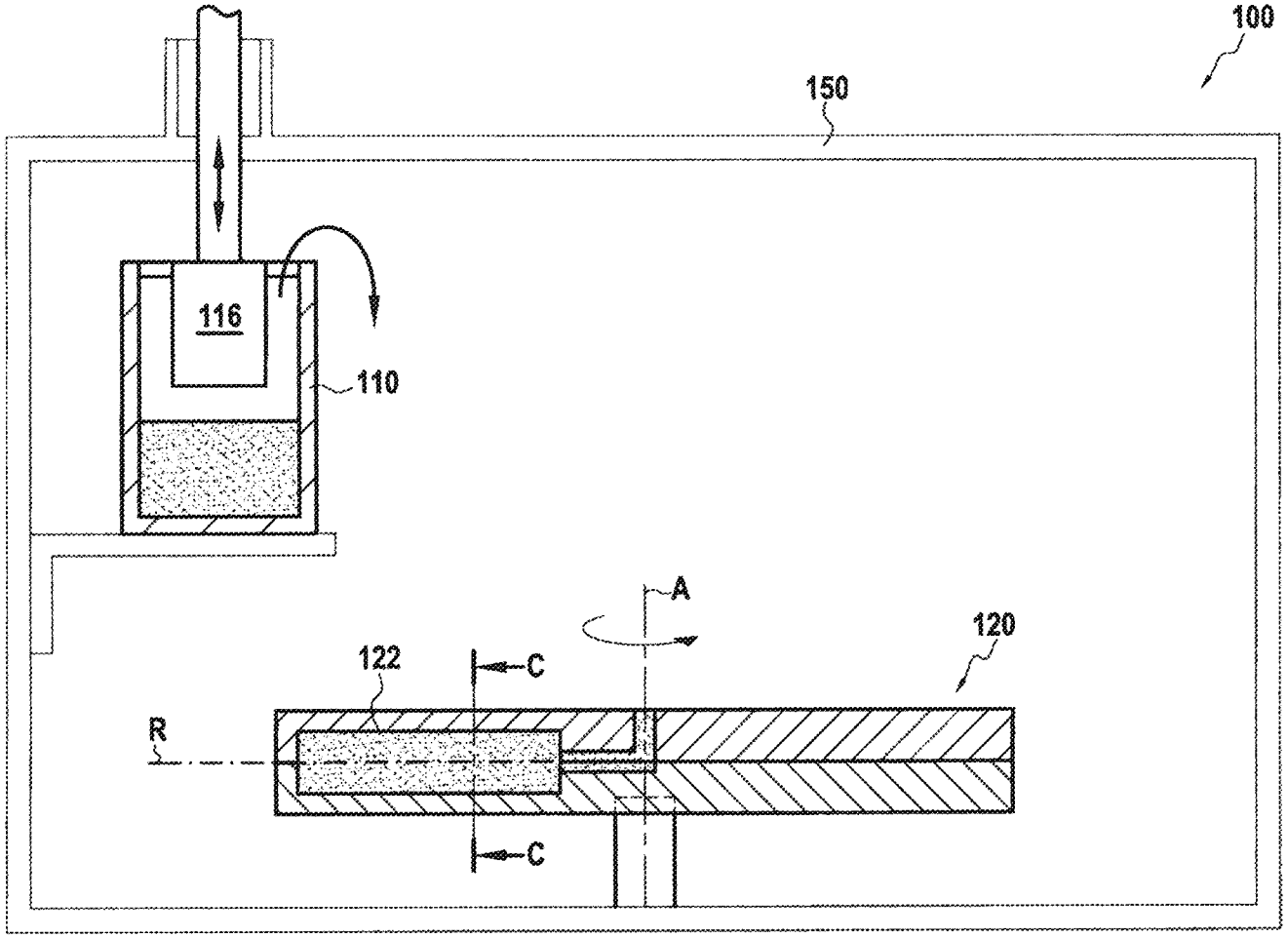
FIG. 1 schematically shows a known device for manufacturing by centrifugal casting.
Figure 2:
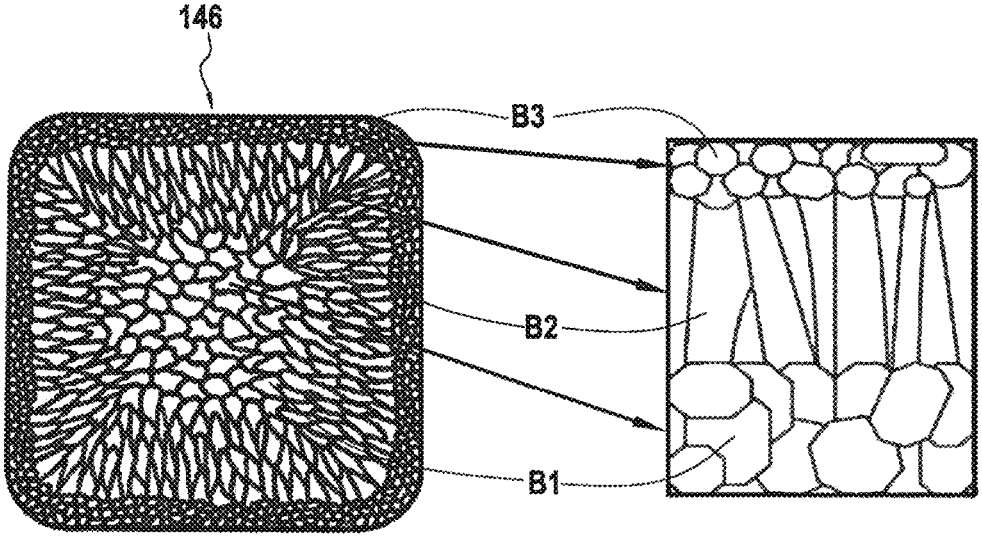
FIG. 2 schematically shows the solidified metal blank obtained by the device of FIG. 1, in section along the plane C-C of FIG. 1.
Figure 3A:
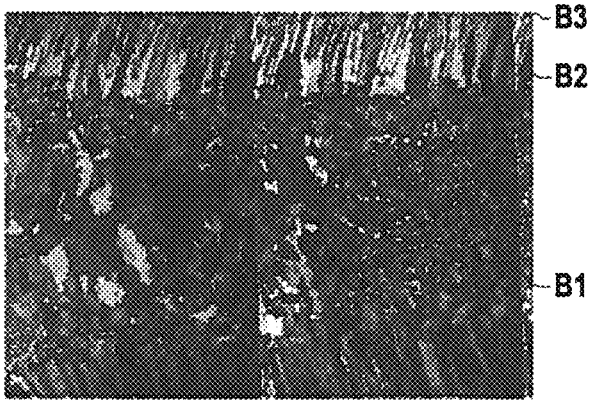
FIGS. 3A and 3B are photographs of sections of two metal blanks obtained by the device of FIG. 1, in the direction R of FIG. 1.
Figure 3B:
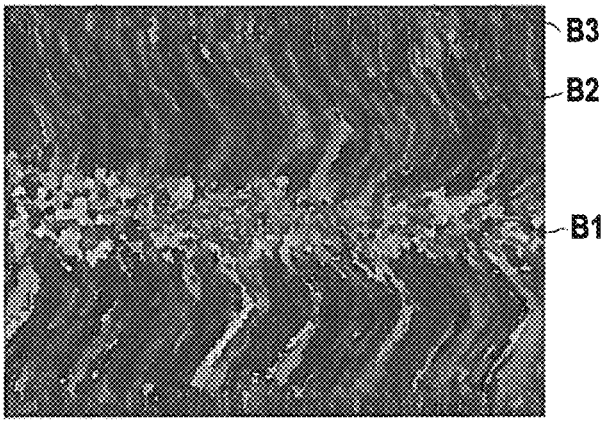
Figure 4:
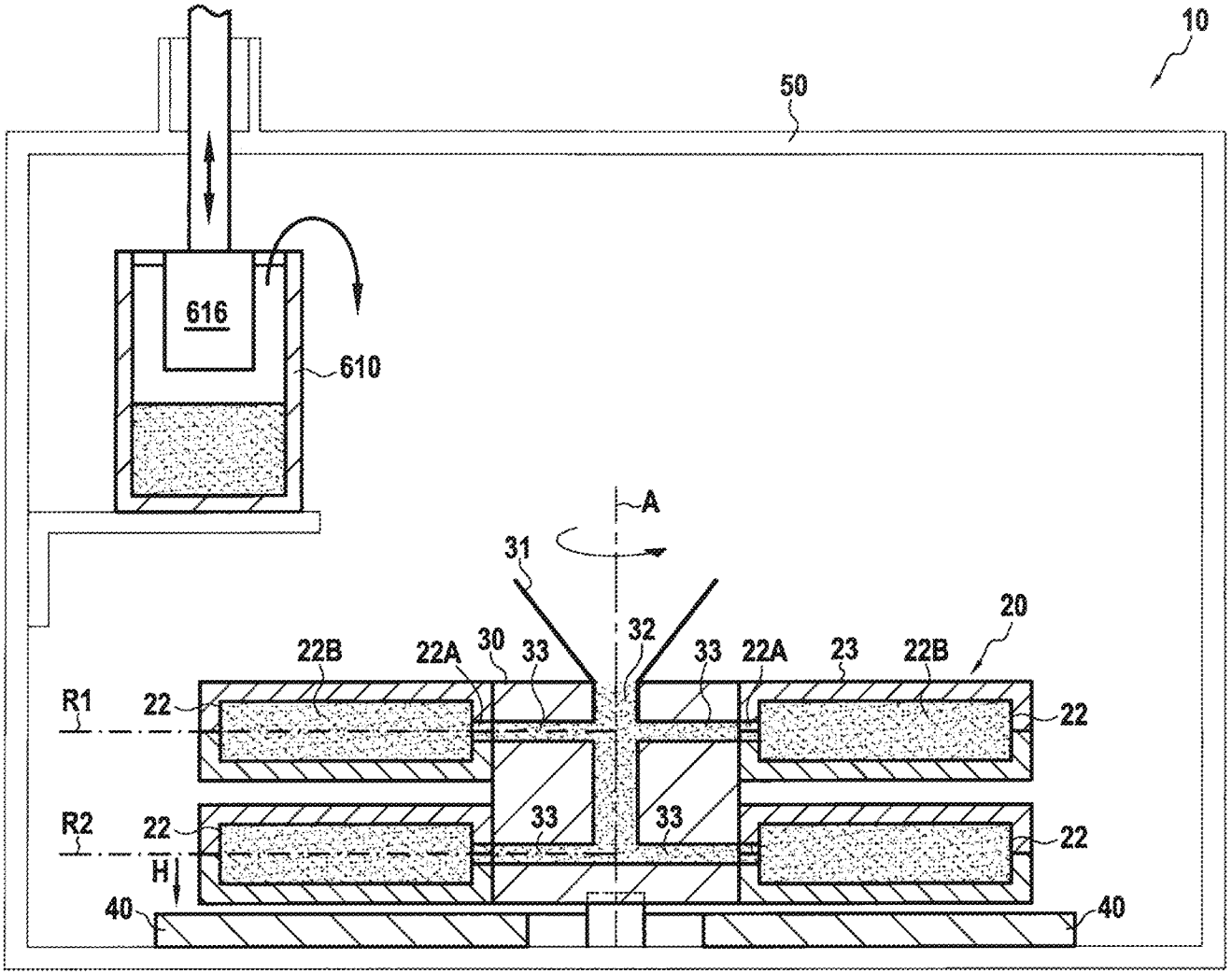
FIG. 4 schematically shows a device for manufacturing by centrifugal casting according to the invention.

FIG. 4 schematically shows a device 10 for manufacturing a metal alloy blank by centrifugal casting of a molten metal alloy.

The manufacturing device 10 comprises, in a closed and airtight chamber 50, a melting device 610, a centrifugal casting wheel 20 (which will subsequently be referred to as "the wheel 20" for convenience) and a magnet 40.

The melting device 610 is suitable for providing a molten metal alloy. In an example, the melting device 610 carries out the melting of a metal alloy provided in the form of an ingot 616 of metal alloy. In another example, the different constituents of the metal alloy are introduced individually into the melting device 610, then melted together in such a way as to obtain the molten metal alloy.

The metal alloy is chosen from among the alloys suitable for the finished part to be manufactured from the blank.

Without wishing to limit the scope of the present disclosure, the metal alloy can be, for example, a ceramic-based alloy, a steel, a titanium-based alloy, or else a nickel-based alloy.

Among titanium-based alloys, the following can notably be envisioned:

- conventional titanium alloys having a crystallographic structure identical to that of pure titanium, such as for example: TA6V, Ti-17, Ti 10-2-3, Ti-5553, β16, β21S; and
- titanium-based intermetallic alloys, having one or more phases of crystallographic structure different from that of pure titanium.

Among titanium-based intermetallic alloys, titanium aluminides may particularly be envisioned, including:

- titanium aluminides with columnar γ and $\alpha_2$ phases, such as: Ti-48Al-1V-0,3C, Ti-48Al-2Cr-2Nb (also known by the name "GE 48-2-2") or Ti-48Al-2Nb-0,75Cr-0,3Si (also known by the name "Daido RNT650");
- titanium aluminides with equiaxed γ and α2 phases, such as Ti-45Al-2Nb-2Mn+0,8$TiB_2$ (also known by the name "Howmet 45XD"), Ti-47Al-2Nb-2Mn+0,8$TiB_2$ (also known by the name "Howmet 47XD"), Ti-47Al-2W-0,5Si-0,5B (also known by the name "ABB-23") or Ti-48Al-1,3Fe-1,1V-0,3B;
- aluminides with equiaxed β, γ and $\alpha_2$ phases, such as Ti-47,3-Al-2, 2N b-0,5Mn-0,4W-0,4Mo-0,23Si, Ti-46, 5Al-3Nb-2Cr-0,2W-0,2Si-0,1C (also known by the name "K5SC"), TI-46Al-5Nb-1W, Ti-47Al-3,7(Cr,Nb, Mn,Si)-0,5B (also known by the name "GKSS-TAB"), Ti-45Al-8(Nb,B,C) (also known by the name "GKSS TNB"), Ti-46,5Al-1,5Cr-2Nb-0,5Mo-0,13B-0,3C (also known by the name "395M"), Ti-46Al-2,5Cr-1Nb-0, 5Ta-0,01B (also known by the name "Plansee γ-MET"), Ti-47Al-1Re-1W-0,2Si (also known by the name "Onera G4"), Ti-43Al-9V-0,3Y, Ti-42Al-5Mn, Ti-43Al-4Nb-1Mo-0,1B, or Ti-45Al-4Nb-4Ta.

It is specified that in the list above, all the numerical values designate the atomic percentage (at %) of the element that they precede. Thus, the alloy Ti-48Al-2Cr-2Nb comprises, in atomic percentage, 48% of Al, 2% of Cr, 2% of Nb, and titanium (Ti) in addition to 100%.

Among the nickel-based alloys, conventional nickel alloys may particularly be envisioned such as René 77 or DS 200, or else nickel superalloys such as AM1.

The melting device 610 can be, for example:

- a furnace for the melting by electrical arc of a metal electrode in a cold crucible in a vacuum or under reduced pressure, more commonly known by the terms "Vacuum Arc Remelting (VAR) furnace" or "Skull VAR furnace";
- a furnace for melting by induction in a vacuum or under reduced pressure, more commonly known by the term "Vacuum Induction Melting (VIM) furnace";
- a furnace for melting by plasma burner under reduced pressure, more commonly known by the term "Plasma Arc Melting (PAM) furnace";
- a furnace for melting by electronic bombardment in a vacuum, more commonly known by the term "Electronic Bombardment (EB) furnace";

or a combination of these.

According to the type of melting device 610 chosen, the chamber 50 is controlled to provide the required atmosphere:

vacuum; or reduced and controlled pressure of an inert gas in relation to the metal alloy; or reduced and controlled pressure of a gas reacting with the metal alloy, in order to modify the chemical composition of the metal alloy during its melting.

The molten metal alloy exiting the melting device 610 is poured into the wheel 20.

The wheel 20 comprises a hub 30, at least one mold 22 attached to the hub 30.

The hub 30 comprises a central channel 32 and several intake channels 33 each communicating with a mold 22.

In order to facilitate the pouring of the molten metal alloy, the hub 30 can be provided with a funnel 31 opening onto the central channel 32.

The hub 30 is liable to be rotationally driven about an axis of rotation A, for example using a motor (not shown). Thus, the wheel 20 is rotary about the axis of rotation A.

In order to simplify the device for balancing the wheel 20, the axis A is preferably vertical.

Figure 5:
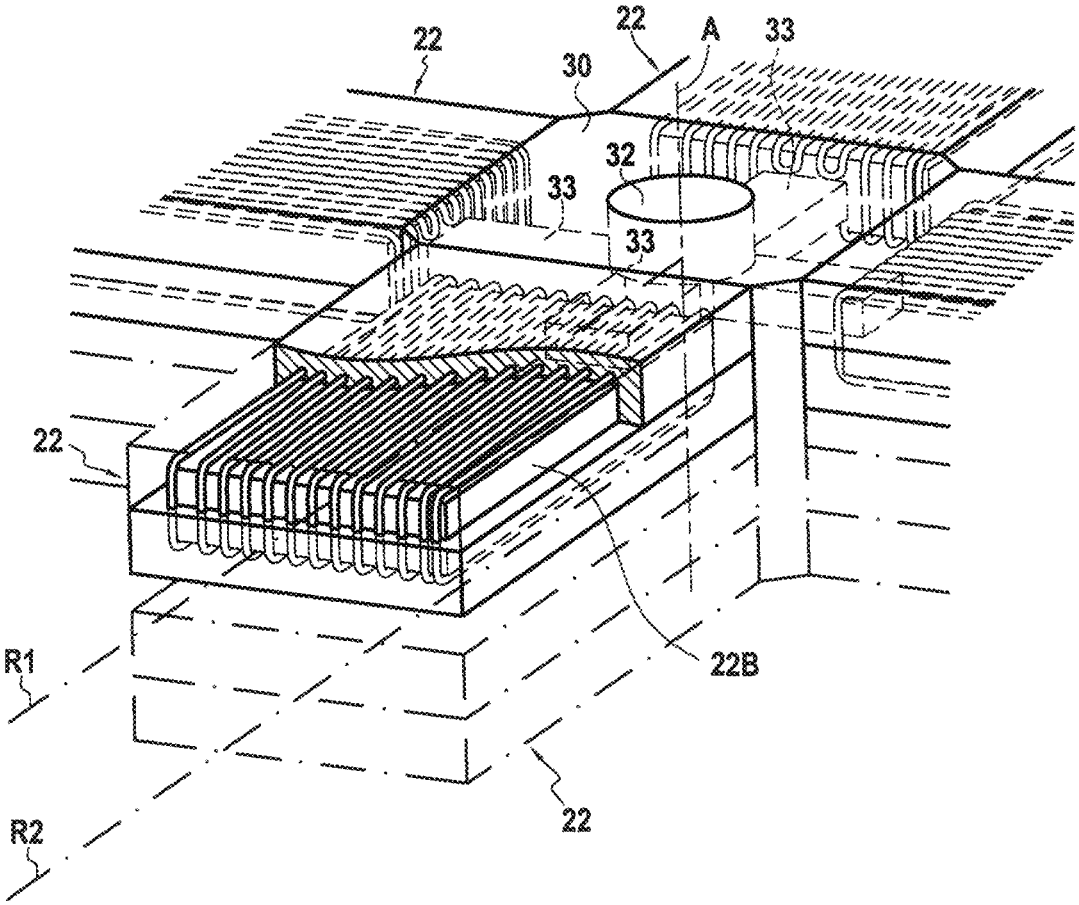
FIG. 5 is a partial perspective and stripped-down view of the device of FIG. 4.

FIG. 5 shows in perspective a mold 22 attached to the hub 30 (the funnel 31 has been left out to avoid crowding the drawing).

The mold 22 extends in a radial direction R1 with respect to the axis A (see FIG. 4). Preferably, in order to simplify the construction of the wheel 20, this radial direction R1 is perpendicular to the axis A. Thus, if the axis A is vertical, the radial direction R1 is parallel to the horizontal.

The mold 22 is able to receive the molten metal alloy, here in a cavity 22B. To do this, the mold 22 is typically made of metal, a metal alloy or a ceramic resistant enough to resist the thermal stresses linked to contact with the molten metal alloy.

The cavity 22B can have a rectangular or cylindrical section. This section can advantageously be constant over the entire length of the cavity 22B.

Along the radial direction R1, the cavity 22B typically has a length considerably greater than the maximum dimension of its section, for example at least 3 times, and preferably at least 5 times greater than the maximum dimension of its section. After solidification, the metal alloy blank then has the general shape of a bar.

The cavity 22B communicates with an intake channel 33 via an intake 22A, which is where applicable of smaller section than the cavity 22B.

Several molds 22 can be attached to the hub 30 as can be seen in FIGS. 4 and 5. For example, several molds 22 can be evenly spaced about the axis A. The molds 22 can also be superimposed in such a way as to form several (two in FIGS. 4 and 5) levels of molds 22.

The molds 22 can be separable from the hub 30, such that they can be individually replaced and/or separated one by one from the hub 30 in order to extract the metal alloy blank from it after solidification.

As mentioned above, the manufacturing device 10 also comprises at least one magnet. In the remainder of the text, for convenience, the term "magnet" will be used, denoted by the reference 40; it should however be noted that the features shown in the remainder of the text in relation to the magnet 40 can be applied to only one, to all or to some of the magnets.

In the remainder of the text, the magnetic field generated by the magnet 40 is denoted H.

In the present description, "magnet" encompasses both permanent magnets and electromagnets, unless otherwise specified.

When the wheel 20 turns about the axis A (the direction of rotation D is indicated in FIGS. 6 to 11), the magnetic field H induces an electric current in the mold 22. This electric current is induced in the walls 23 of the mold 22 (especially if it is made of a metal or metal alloy), and also in the molten metal alloy contained in the cavity 22B. This electric current generates an induced magnetic field in the mold 22. As is known, this induced magnetic field creates a Laplace force.

This Laplace force tends to stir the molten metal alloy in the method of solidification in the cavity 22B.

The stirring of the molten metal alloy in the cavity 22B has the following effects:

in front of the solidification front of the metal alloy (in other words in its still-melting part), allowing the grain seeds to grow in three dimensions, which promotes the formation of equiaxed grains;

at the solidification front, breaking the tips of any columnar grains, which adversely affects the formation of columnar grains and also has the advantage of providing new seeds of equiaxed grains.

It will therefore be understood that the stirring of the molten metal alloy considerably promotes the formation of equiaxed grains with respect to the formation of columnar grains. As a consequence, the metal alloy blank has a homogenous, and therefore virtually isotropic, structure, which eliminates the drawbacks discussed above.

In addition, the stirring makes it possible to constantly re-homogenize the chemical composition of the molten metal alloy, both in front of the solidification front and at the solidification front. This makes it possible to avoid any local segregation, and consequently any aligned positive segregation or exudation into the blank.

In addition, at the solidification front, the stirring makes it possible to improve the supply of molten metal alloys during the solidification shrinkage. The blank consequently has virtually no residual porosity after cooling. This avoids the need to subject the blank to a step of Hot Isostatic Pressing (HIP).

The manufacturing device 10 therefore makes it possible to obtain a metal blank with improved mechanical and structural properties, which can be more easily machined and/or subjected to hot shaping operations (forging, rolling, extrusion etc.) Moreover, subsequent operations to be carried out on the blank are less expensive since the hot isostatic compression step is no longer necessary.

In order to reinforce the stirring of the molten metal alloy, the mold 22 can be provided with a coil 60, as seen in FIG. 5.

The coil 60 comprises one, or more typically several, windings electrically connected together. The windings of the coil 60 surround an internal volume of the mold 22. In the example shown in FIG. 5, this internal volume is the entire cavity 22B. It could also be only a part of the cavity 22B.

In the meaning of the present description, the fact that the windings of the coil 60 surround an internal volume of the mold 22 means that said internal volume is contained in the volume delimited by the windings of the coil 60. Thus, the windings of the coil 60 can be sunk into the walls 23 of the mold 22 as shown in FIG. 5, or else arranged on the external surface of the walls 23.

When the wheel 20 turns about the axis A, an electric current I is induced in the coil 60, in addition to the current induced in the walls 23 of the mold 22 and in the molten metal alloy. The Laplace force exerted on the molten metal alloy is therefore more intense, which improves the stirring of the molten metal alloy.

Preferably, the windings extend parallel to the radial direction R1. This maximizes the area swept by the coil during the rotation of the wheel 20, in particular if the cavity 22B has a length considerably greater than the maximum dimension of its section as explained above.

Figure 6:
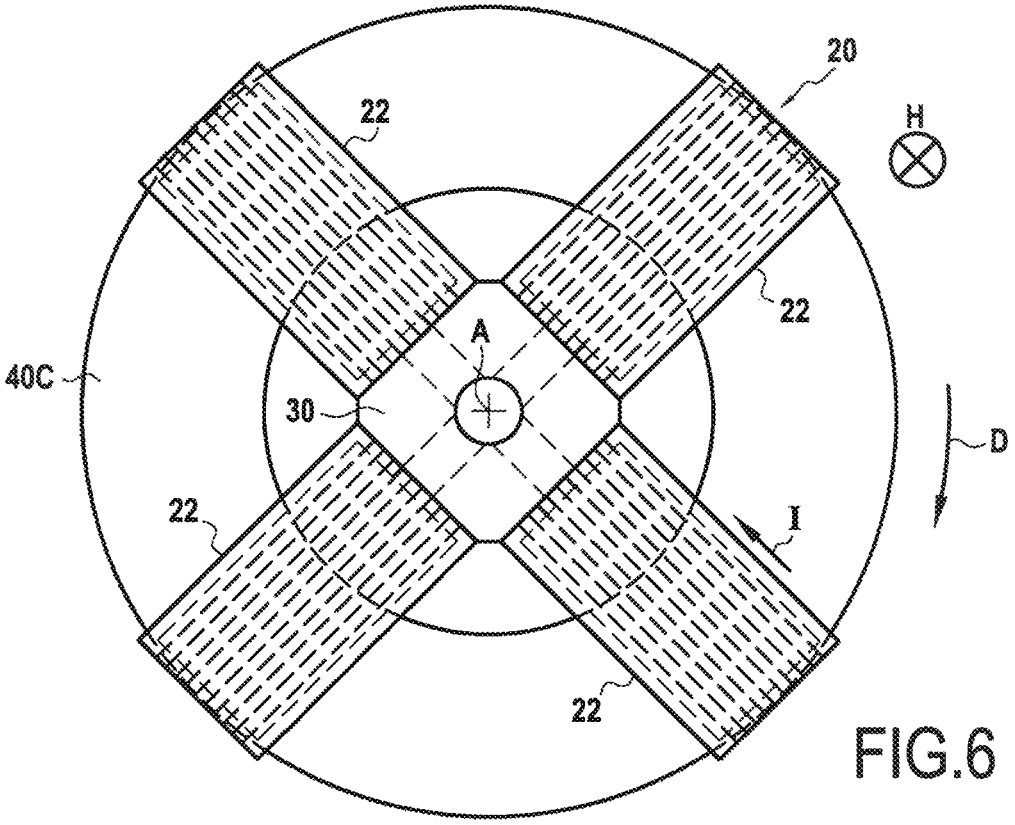
FIG. 6 is a top view of the centrifugal casting wheel and of the magnet, according to another variant of the invention.

As shown in FIG. 6, the magnet 40 can be an annular magnet 40C the axis of which is parallel to the axis A. It can also be a circular magnet.

The magnet 40C makes it possible to obtain a magnetic field H substantially uniform over the whole volume swept by the mold 22 during the rotation of the wheel 20.

Preferably, the axis of the magnet 40C is colinear with the axis A. The magnetic field H is then more uniform over the whole of the volume swept by the mold 22 during the rotation of the wheel 20.

Figure 7:
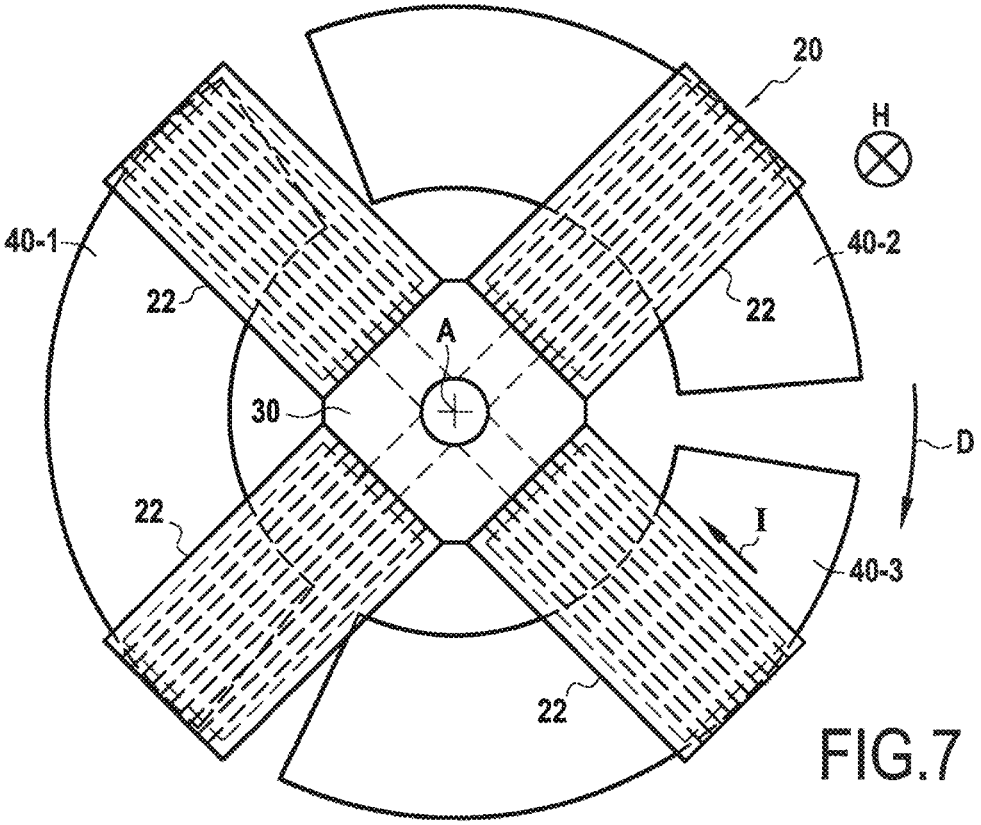
FIG. 7 is a top view similar to FIG. 6, according to yet another variant of the invention.

In a variant, as shown in FIG. 7, the device comprises a plurality (here three) magnets 40-1, 40-2, 40-3 each arranged in such a way as to induce an electric current in the mold 22 and where applicable in the coil 60.

The magnets 40-1, 40-2, 40-3 are arranged in a spaced manner about the axis A. In other words, between the magnets 40-1, 40-2, 40-3, there are spaces without magnets. Consequently, the magnetic field H varies according to the angular position of the mold 22. It follows that the electric current induced by the magnet in the mold 22, and therefore the Laplace force, in the mold 22 is variable during the rotation of the wheel 30, which improves the stirring of the molten metal alloy inside the mold 22.

Preferably, in order to simplify the construction of the manufacturing device 10, the magnets 40-1, 40-2, 40-3 are all identical.

It is also preferable that the magnets 40-1, 40-2, 40-3 be evenly spaced apart.

The magnets 40-1, 40-2, 40-3 can have the shape of annular segments, the axis of which is parallel to the axis A as shown in FIG. 7. It can also be circular segments. As in the variant of FIG. 6, it is preferable that the axis of the annular or circular segments be colinear with the axis A.

Figure 8:
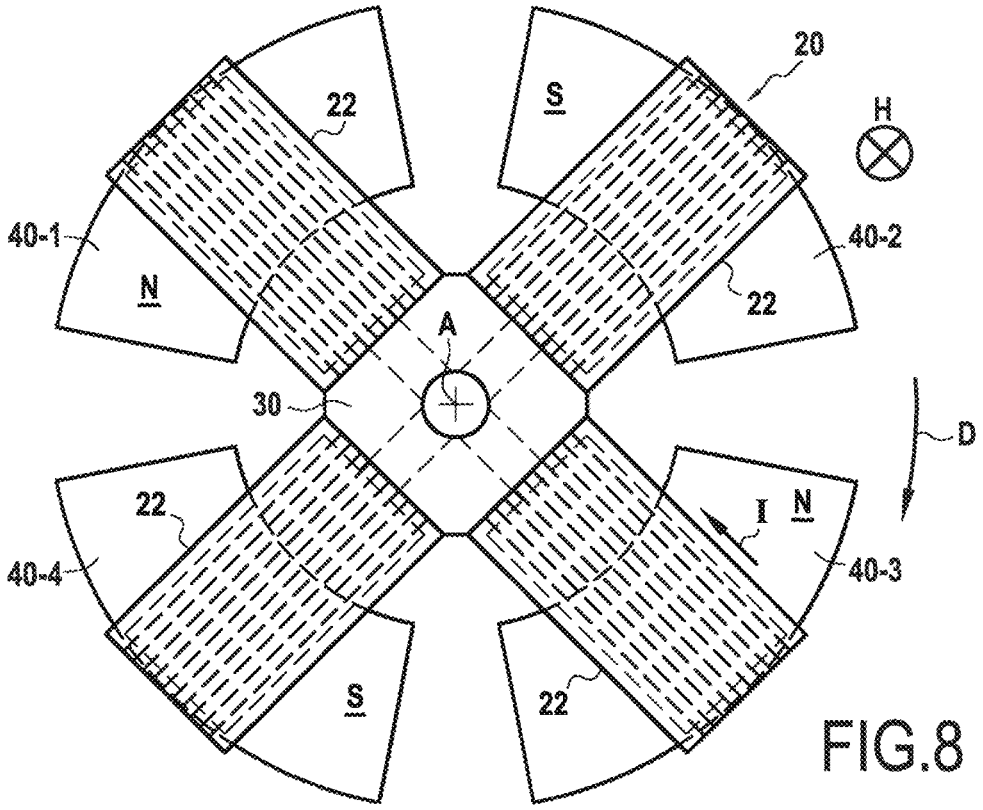
FIG. 8 is a top view similar to FIG. 7, according to yet another variant of the invention.

Preferably, as shown in FIG. 8, the magnets are even in number (here, four magnets 40-1 to 40-4), and the polarities of the magnets alternate evenly about the axis A. In other words, following the direction of rotation of the wheel 20, the pole of the magnets 40-1 to 40-4 facing the wheel 20 is alternatively North, South, North, South etc.

Thus, the magnetic field H applied to the mold 22 changes direction periodically during the rotation of the wheel 20, which further improves the stirring of the molten metal alloy inside the mold 22. If the magnets 40-1 to 40-4 are evenly spaced and identical, the magnetic field H is alternating.

Figure 9:
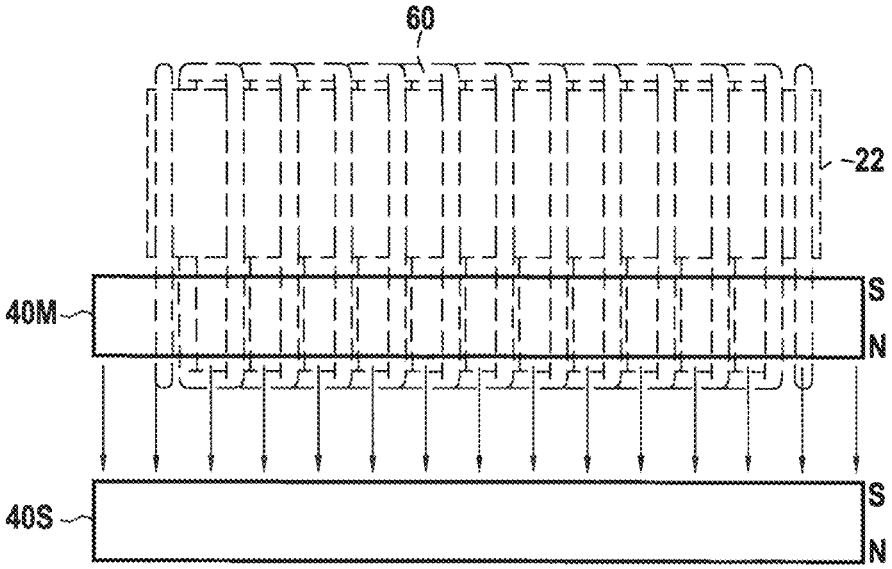
FIG. 9 is a side view of a part of the centrifugal casting wheel, according to yet another variant of the invention.

According to yet another variant schematically shown in FIG. 9, the device 10 further comprises a permanent magnet 40M forming a single part with the wheel 20. The magnet 40 itself has the form of a magnet 40S not forming a single part with the wheel 20. Typically, the magnet 40S is fixed with respect to the chamber 50. The permanent magnet 40M extends partly across the coil 60 of the mold 22.

Preferably, the poles of the permanent magnet 40M and the magnet 40S facing one another have opposite names (i.e. if one of the poles is North, the other is South). Thus, at the level of the windings located between the permanent magnet 40M and the magnet 40S, the magnetic field H is virtually uniform, as schematically shown in FIG. 9. This increases the intensity of the induced electric current in the coil 60 and therefore the intensity of the stirring.

Furthermore, if the windings of the coil 60 extend parallel to the radial direction R1, the lines of the magnetic field Hare aligned with the windings of the coil, which further increases the intensity of the current induced in the coil 60 and therefore the intensity of the stirring.

Figure 10:
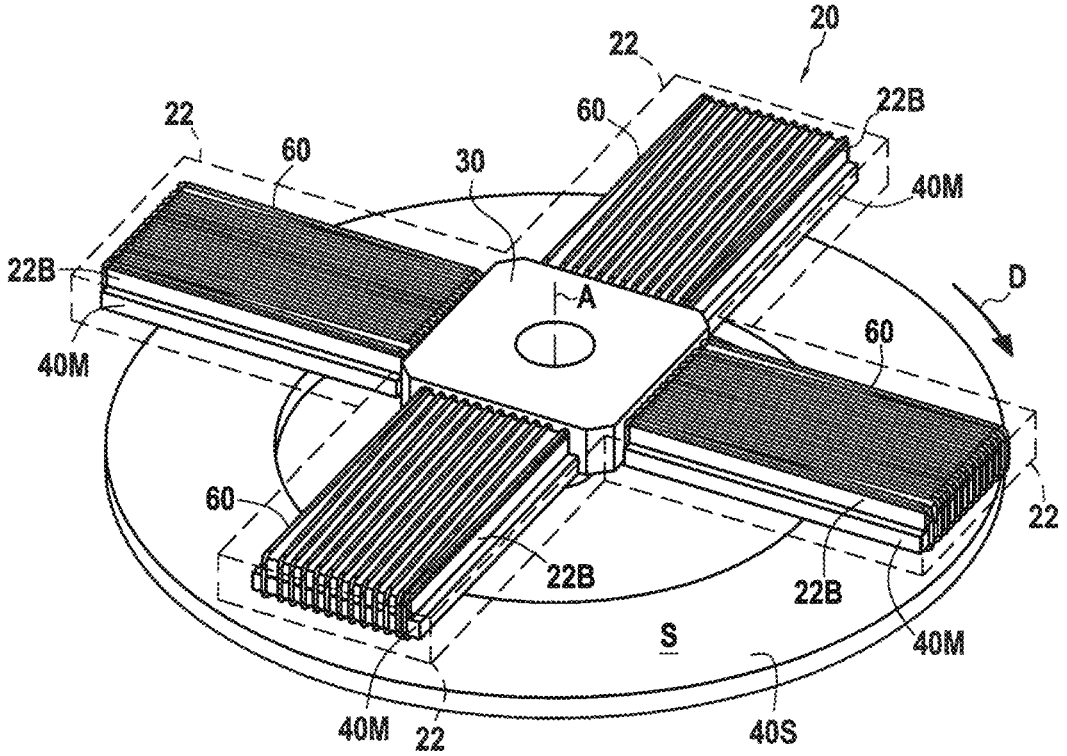
FIG. 10 is a perspective view of FIG. 9, showing a first possibility of implementation of the variant of FIG. 9.

As shown in FIG. 10, the magnet 40S can be an annular magnet, the axis of which is parallel to the axis A. It can also be a circular magnet.

Such an annular or circular magnet makes it possible to obtain a magnetic field H substantially uniform over the whole volume swept by the mold 22 during the rotation of the wheel 20. As shown in FIGS. 9 and 10, it is preferable that the poles of the permanent magnet 40M and the annular or circular magnet 40S facing one another have opposite names.

Figure 11:
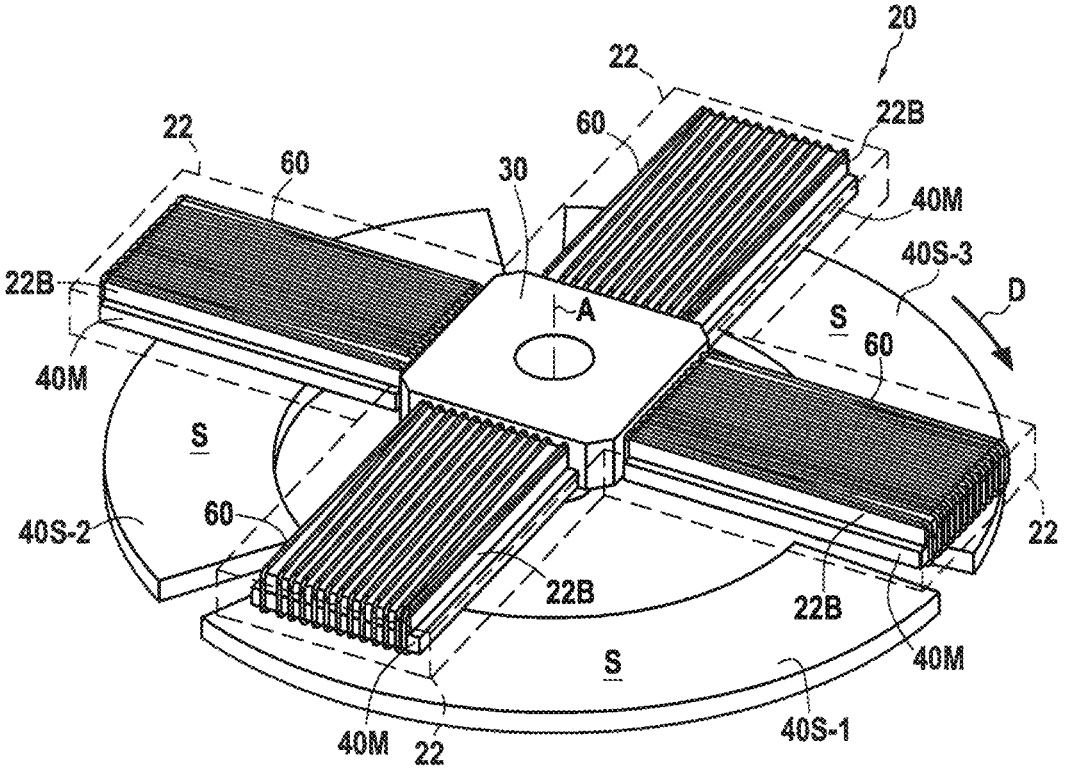
FIG. 11 is a perspective view of FIG. 9, showing another possibility of implementation of the variant of FIG. 9.

In a variant, as shown in FIG. 11, the device comprises a plurality (here three) magnets 40S-1, 40S-2, 40S-3 not forming a single part with the wheel 20 and each arranged in such a way as to induce an electric current in the mold 22 and where applicable in the coil 60.

In the variant shown in FIG. 11, the magnets 40S-1, 40S-2, 40S-3 are such that their poles all have a name opposite to that of the magnet 40M which they face (i.e. if the poles of the magnets 40S-1, 40S-2, 40S-3 are North, the pole of the magnet 40M they face is South).

In another variant (not shown), the magnets not forming a single part with the wheel (20) are even in number, and the polarities of said magnets alternate evenly about the axis A. In other words, following the direction of rotation of the wheel 20, the pole of these magnets facing the wheel 20 is alternatively North, South, North, South etc.

Although the present invention has been described with reference to specific exemplary embodiments, it is obvious that modifications and changes can be made to these examples without departing from the general scope of the invention as defined by the claims. Furthermore, individual features of the different embodiments described can be combined in additional embodiments. Consequently, the description and the drawings must be considered in an illustrative sense rather than a restrictive one.

The invention claimed is:

1. A device for manufacturing a metal alloy blank by centrifugal casting of a molten metal alloy, comprising a centrifugal casting wheel, the centrifugal casting wheel being rotary about an axis of rotation and comprising a hub and a plurality of molds fixed to the hub for receiving the molten metal alloy, each mold of the plurality of molds extending in a radial direction with respect to the axis of rotation evenly spaced about the axis, the device comprising at least one magnet arranged in such a way as to induce an electric current in the mold during the rotation of the centrifugal casting wheel about the axis of rotation, each mold being provided with a coil comprising windings that surround an internal volume of the mold, the windings extending parallel to the radial direction.

2. The device according to claim 1, wherein the coil is configured in such a way that the at least one magnet induces an electric current in the coil during said rotation of the centrifugal casting wheel about the axis of rotation.

3. The device according to claim 1, wherein the at least one magnet is an annular or circular magnet, an axis of which is parallel to the axis of rotation.

4. The device according to claim 1, comprising a plurality of magnets arranged in a spaced manner about the axis of rotation.

5. The device according to claim 4, wherein the magnets are even in number, and polarities of said magnets alternate evenly about the axis of rotation.

6. The device according to claim 2, wherein the at least one magnet does not form a single part with the centrifugal casting wheel, and further comprising a permanent magnet forming a single part with the centrifugal casting wheel and extending partly across the coil.

7. The device according to claim 6, wherein the at least one magnet is an annular or circular magnet, an axis of which is parallel to the axis of rotation, and the poles of the permanent magnet and of the at least one magnet facing it have opposite names.

8. The device according to claim 6, comprising a plurality of magnets not forming a single part with the centrifugal casting wheel and arranged in a spaced manner about the axis of rotation.

9. The device according to claim 8, wherein the magnets not forming a single part with the centrifugal casting wheel are even in number, and polarities of said magnets alternate evenly about the axis of rotation.

10. The device according to claim 6, wherein the permanent magnet is disposed under the plurality of molds and extends in plane perpendicular to the axis.

11. The device according to claim 1, wherein the plurality of molds are superimposed in such a way as to form several levels of mold.

12. The device according to claim 1, wherein the device comprises a motor for rotationally driving the centrifugal casting wheel about the axis.

13. A method for manufacturing a metal alloy blank using the device according to claim 1, comprising the following steps:

melting of the metal alloy;

pouring of the molten metal alloy into the centrifugal casting wheel, the centrifugal casting wheel being rotary about the axis of rotation and comprising the plurality of molds for receiving the molten metal alloy, each mold extending in the radial direction with respect to the axis of rotation;

rotation of the centrifugal casting wheel about its axis of rotation and solidification of the molten metal alloy inside each mold, in such a way as to obtain the metal alloy blank; and extraction of the metal alloy blank from each mold, a magnetic field being applied to each mold during the rotation step in such a way as to induce an electric current in each mold.

14. The method according to claim 13, wherein, during the rotation step, the magnetic field induces an electric current in the coil.

15. The method according to claim 13, wherein the metal alloy is a titanium-based alloy.

* * * * *